US009790692B2

(12) United States Patent
Bernicke-Grussing et al.

(10) Patent No.: US 9,790,692 B2
(45) Date of Patent: Oct. 17, 2017

(54) JOINT COMPOUND TOOL

(71) Applicant: United States Gypsum Company, Chicago, IL (US)

(72) Inventors: Nancy L Bernicke-Grussing, Trevor, WI (US); Joshua Sheldon, Vernon Hills, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 0 days.

(21) Appl. No.: 14/476,426

(22) Filed: Sep. 3, 2014

(65) Prior Publication Data

US 2016/0060884 A1 Mar. 3, 2016

(51) Int. Cl.

| | |
|---|---|
| ***E04F 21/16*** | (2006.01) |
| ***E04F 21/165*** | (2006.01) |
| ***B65D 25/10*** | (2006.01) |
| ***B65D 43/00*** | (2006.01) |
| ***E04F 21/06*** | (2006.01) |
| ***B25H 3/00*** | (2006.01) |

(52) U.S. Cl.

CPC ..... *E04F 21/1655* (2013.01); *B25H 3/006* (2013.01); *B65D 25/10* (2013.01); *B65D 43/00* (2013.01); *E04F 21/06* (2013.01); *E04F 21/165* (2013.01)

(58) Field of Classification Search

CPC ..... A47L 1/16; A47L 13/08; B25H 3/006; B25H 3/02; B25H 3/06; B44D 3/121; B44D 3/123; B44D 3/125; B44D 3/162; B44D 3/164; B65D 50/067; B65D 51/243; B65D 51/246; B65D 51/32; B65D 2543/00194; B65D 2543/00296

USPC .... 206/209, 223, 229, 349, 373, 362, 459.5, 206/503, 561, 592; 220/570, 694, 697, 220/702, 735; 15/105, 111, 235.7, 15/236.01–236.02, 236.05, 236.08, 236.1, 15/245.1, 246, 257.01; 366/129, 279, 366/343, 605; D32/48–49

See application file for complete search history.

(56) References Cited

U.S. PATENT DOCUMENTS

| | | | | |
|---|---|---|---|---|
| 1,000,333 A * | 8/1911 | Hail | E04F 21/06 15/245.1 |
| D53,548 S * | 7/1919 | Wilson | 30/324 |
| 1,710,113 A * | 4/1929 | Rothermel | B44D 3/162 15/236.01 |
| 1,868,013 A | 7/1932 | Humphreys | |

(Continued)

FOREIGN PATENT DOCUMENTS

GB 909407 A 10/1962

OTHER PUBLICATIONS

International Search Report for PCT/US2015/046457 dated Oct. 16, 2015.

*Primary Examiner* — Chun Cheung
*Assistant Examiner* — Brijesh V. Patel
(74) *Attorney, Agent, or Firm* — Greer, Burns & Crain, Ltd.; Pradip Sahu; Philip T. Petti

(57) ABSTRACT

A joint compound tool including a handle having a first end and a second end where a blade portion is attached to the first end and a mixing member is attached to the second end. The handle, the blade portion and the mixing member each have substantially the same thickness where the mixing member is used to mix joint compound and the blade is used to apply the joint compound to a surface.

5 Claims, 5 Drawing Sheets

(56) References Cited

U.S. PATENT DOCUMENTS 1,898,690 A * 2/1933 Schacht ..... A47L 13/08 15/143.1
2,127,682 A * 8/1938 Ewing ..... B44D 3/125 206/209
D152,781 S * 2/1949 Gier ..... 81/15.2
D156,638 S * 12/1949 Lifshutz ..... 15/236.02
2,719,316 A * 10/1955 Hauser ..... A47L 13/08 15/105
3,408,677 A * 11/1968 Yates ..... A47L 1/16 15/236.01
3,530,524 A * 9/1970 Clemans ..... B44D 3/162 15/236.08
D219,303 S * 11/1970 Golden ..... D32/49
3,964,161 A * 6/1976 Wise ..... A47J 43/281 294/7
4,200,948 A * 5/1980 Nesseth ..... B44D 3/164 15/105
4,207,781 A * 6/1980 Greenwood ..... B67B 7/403 81/3.55
D256,212 S * 8/1980 Richmond ..... D7/644
4,350,445 A * 9/1982 Olsson ..... B01F 13/002 366/129
4,536,910 A * 8/1985 Clark ..... B44D 3/105 15/236.01
D287,692 S * 1/1987 Brailsford ..... D8/16
4,834,237 A * 5/1989 Henke ..... B44C 7/00 15/257.06
D321,303 S * 11/1991 Augustino ..... D7/688
5,065,977 A 11/1991 Desjardin
5,085,317 A 2/1992 Jensen et al.
5,203,471 A 4/1993 Widman
D343,100 S * 1/1994 Jenkinson ..... D7/688
5,351,357 A * 10/1994 Liberman ..... E04F 21/06 15/245
D357,775 S * 4/1995 Panchuk ..... D32/35
D363,863 S * 11/1995 Tipp ..... D8/18
D366,178 S * 1/1996 Edwards ..... D7/644
5,509,380 A * 4/1996 Tipp ..... B67B 7/403 81/3.55
5,555,592 A * 9/1996 Crego ..... B44D 3/162 15/104.8
5,555,974 A * 9/1996 Donald ..... B44D 3/04 206/1.7
5,638,570 A * 6/1997 Gruner ..... E04F 21/1655 15/235.7
D381,149 S * 7/1997 Mayo ..... D32/49
D386,372 S * 11/1997 Weiss ..... D28/25
D457,699 S * 5/2002 Raimonde ..... D32/46
6,530,500 B2 3/2003 Rowles et al.
6,685,018 B1 2/2004 Chuan
6,735,840 B2 * 5/2004 Gibbs ..... B44D 3/162 15/236.07
6,802,715 B1 * 10/2004 Wotton ..... B05C 17/00 206/1.7
6,859,973 B1 3/2005 Oranday
D519,697 S * 4/2006 Fritsche ..... D32/43
7,040,498 B2 5/2006 Rickman et al.
7,325,687 B2 2/2008 Bravo et al.
D608,602 S * 1/2010 Davies ..... D7/642
7,703,641 B2 4/2010 Bravo et al.
D664,319 S * 7/2012 Thompson ..... D32/46
8,321,989 B1 * 12/2012 McClanahan ..... B44D 3/162 15/236.01
D682,498 S * 5/2013 Sonne ..... D32/48
D687,202 S * 7/2013 Motsenbocker ..... D32/46
8,662,300 B1 3/2014 Arena
8,741,068 B2 * 6/2014 Thompson ..... A47L 17/06 134/6
D715,506 S * 10/2014 Binne ..... D32/46
2005/0175730 A1 * 8/2005 Belcher ..... E04F 21/165 425/458
2005/0217034 A1 10/2005 Miller et al.
2007/0029215 A1 2/2007 Martinez et al.
2008/0178393 A1 * 7/2008 Kinskey ..... B25F 1/02 7/105
2009/0100624 A1 * 4/2009 MacCormick ..... A46B 9/02 15/223
2009/0272665 A1 11/2009 Cornell
2009/0308870 A1 12/2009 Chapman et al.
2012/0037634 A1 2/2012 Kiceniuk, Jr. et al.

* cited by examiner

JOINT COMPOUND TOOL

BACKGROUND

The present application relates generally to hand tools used in wall finishing, and more particularly to such tools used for mixing and applying joint compound.

Joint compound is available in various forms including a ready-mixed form that is pre-mixed and can be immediately applied to a surface and in a powder form that must be mixed with water prior to application. For larger quantities, the powder is mixed in a large container, such as a five gallon bucket, by hand or with a powered mixing tool. For smaller quantities, the powder is mixed in a relatively small container, such as a mud pan, that can be held with one hand and mixed with the other hand using a mixing stick, the blade of a spackle knife or the like. Because the edges of the blade could be scratched or damaged during mixing, it is preferable to use a separate mixing tool to mix the joint compound and use a spackle knife to apply it to a surface. Carrying multiple tools at a job site can be cumbersome and difficult, especially when working on a ladder or scaffolding. Also, tools are commonly lost or misplaced, so reducing the number of tools needed at a job site minimizes down time and enhances efficiency.

Accordingly, there is a need for a joint compound tool that performs multiple functions.

SUMMARY

The present joint compound tool is a single tool having an end for mixing a quantity of joint compound and an opposing end for applying the mixed joint compound to a surface.

In an embodiment, a joint compound tool is provided that includes a handle having a first end and a second end where a blade portion is attached to the first end, and a mixing member is attached to the second end. The handle, the blade portion and the mixing member each have substantially the same thickness, where the mixing member is used to mix joint compound and the blade is used to apply the joint compound to a surface.

In another embodiment, a joint compound tool assembly is provided and includes a container having a bottom wall and a sidewall extending from the bottom wall, where the bottom wall defines a receptacle. A joint compound tool is configured to be inserted and secured in the receptacle. The tool includes a handle having a first end and a second end, a blade portion attached to the first end and a mixing member attached to the second end, where the handle, the blade portion and the mixing member each have substantially the same thickness such that when the tool is secured in the receptacle, a surface of the tool is substantially flush with the bottom wall of the container.

DETAILED DESCRIPTION

The present tool is a single tool with multiple blades that is configured for enabling a user to both mix a quantity of joint compound and apply the mixed joint compound to a surface. Thus, the user saves time and costs by reducing the number of separate tools that need to be brought to, carried and used at a job site.

Figure 1:
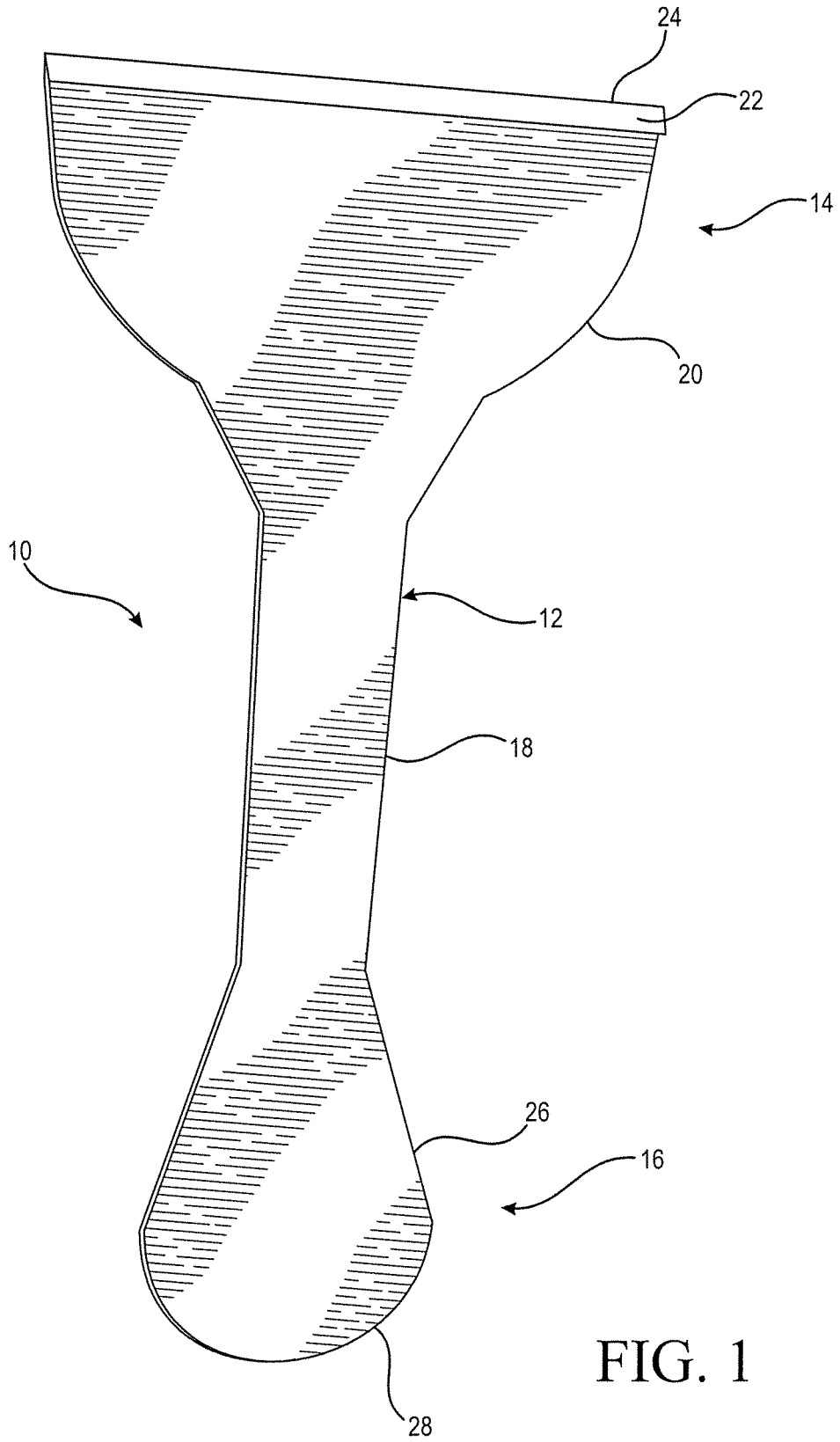
FIG. 1 is a top perspective view of the tool of the present disclosure.
Figure 2:
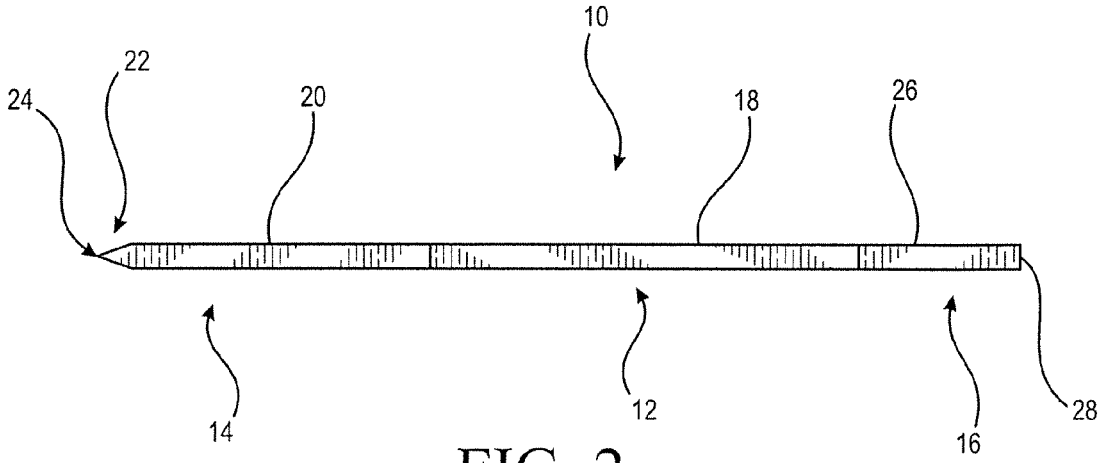
FIG. 2 is a side view of the tool of FIG. 1.
Figure 3:
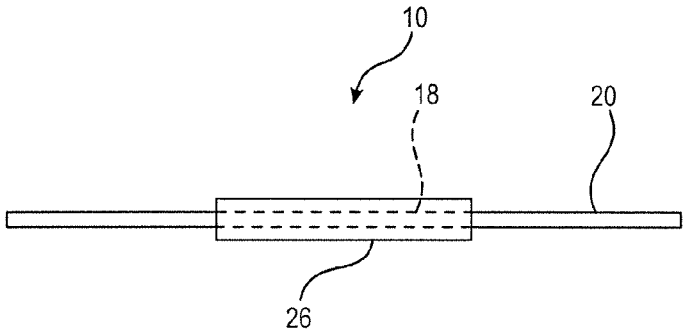
FIG. 3 is an end view of the tool of FIG. 1 as viewed from the end including the mixing member.

Referring now to FIGS. 1-3, the tool generally designated as reference number 10 includes a generally flat body 12 having a first end 14, a remote and preferably opposing second end 16, and a handle 18 between the first end and the second end. The first end 14 is wider than the handle 18 and includes a blade portion 20 integrally formed with the handle. A blade 22 is attached to the blade portion 20 and has a pointed edge 24 configured for applying joint compound to a surface or surfaces. The body 12 may be made with a single material, such as a durable plastic, where the pointed edge is formed in or molded on the blade portion. The blade 22 may also be attached to the blade portion 20 and made with the same material or a different material than the blade portion. For example, the blade portion 20 may be made with plastic and the blade 22 made with a metal such as stainless steel.

The handle 18 extends from the blade portion 20 and has a sufficient length to be easily gripped by a user's hand. In an embodiment, the handle 18 has a width of 1.0 to 1.5 inches and a length of 4.0 to 4.5 inches. It should be appreciated that the width and length of the handle 18 may be any suitable width and length. The flat profile of the handle 18 enables the handle to be easily gripped by a user and stored in a tool container, the user's pocket or other suitable container.

Figure 6:
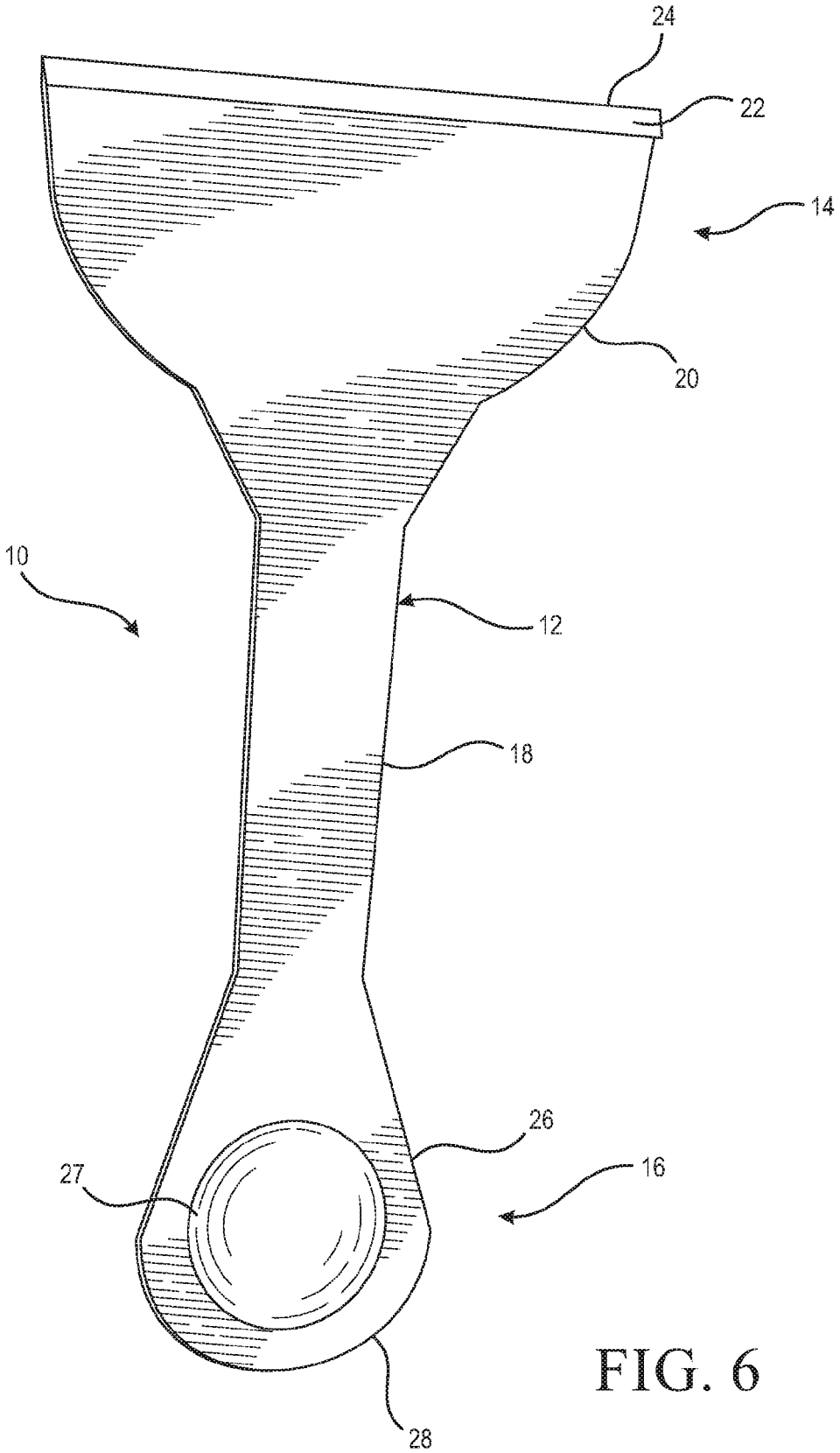
FIG. 6 is a top perspective view of another embodiment of the tool.
Figure 7:
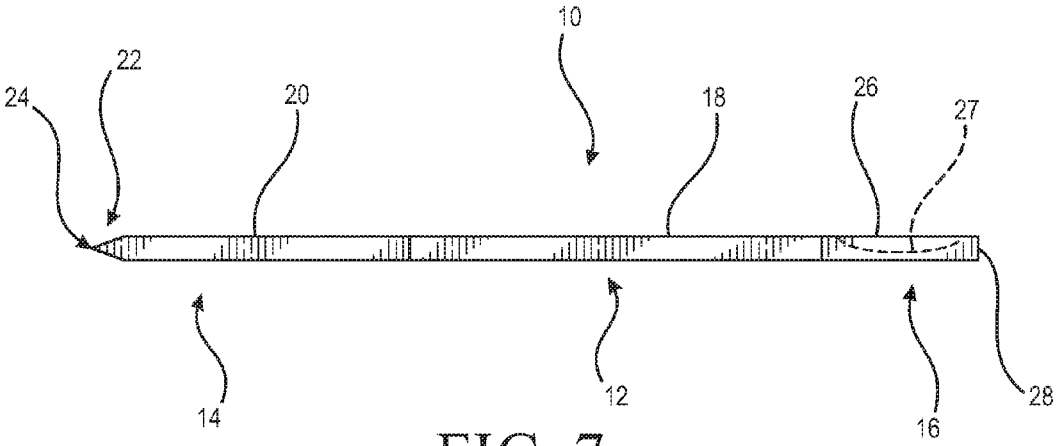
FIG. 7 is a side view of the tool of FIG. 6.

A mixing member 26 extends from the handle 18 at the second end 16 of the body 12. In this application, "end" is contemplated as being broadly defined, in that the blade 22 and the mixing member 26 are potentially positioned on one end and one side of the body 12, and are not necessarily diametrically opposite each other. The mixing member 26 tapers outwardly from the handle 18 and has a curved or rounded peripheral edge 28. The curved edge 28 of the mixing member 26 enables the mixing member to be easily moved along curved surfaces or into corners of containers to thoroughly mix joint compound in the containers. While any width is contemplated, the mixing member 26 preferably has a width of 3.0-3.5 inches. Furthermore, as shown in FIGS. 6 and 7, in an embodiment, the mixing member 26 has a curved or cup-shaped configuration 27 to be able to scoop and mix the joint compound thereby further enhancing the ability of the tool 10 to mix joint compound.

Typically at a job site, joint compound is mixed in a container using a mixing tool or the blade or handle of a mud knife. Thus, multiple tools are required at a job site to mix and apply the joint compound which is burdensome and time consuming. Alternatively, using the blade of a mud knife to mix the joint compound could damage the blade or leave residue on the blade making it difficult to smoothly apply the mixed joint compound to a surface. Similarly, using the handle of the mud knife may leave residue on the handle which will make the handle slippery and difficult to grip.

The present tool 10 is a single tool that overcomes the above issues. In use, the mixing end and mixing member 26 of the tool is inserted into a container including joint compound powder and water and moved around in the container to mix the joint compound. The flat profile of the mixing member 26 enables the joint compound to be easily and smoothly mixed in the container. Also, since the mixing member 26 is spaced from the handle 18, less of the mixed joint compound gets on the handle enabling a user to firmly grip the handle during use.

After mixing the joint compound, the mixed joint compound is applied to a surface, such as a wall, with the blade 22 and spread onto the surface. Similar to the mixing member 26, the blade is spaced from the handle 18 such that the mixed joint compound is less likely to get on the handle during use. The blade 22 has the narrowed or pointed edge 24 for facilitating smooth spreading by a user of the mixed joint compound on the surface.

Figure 4:
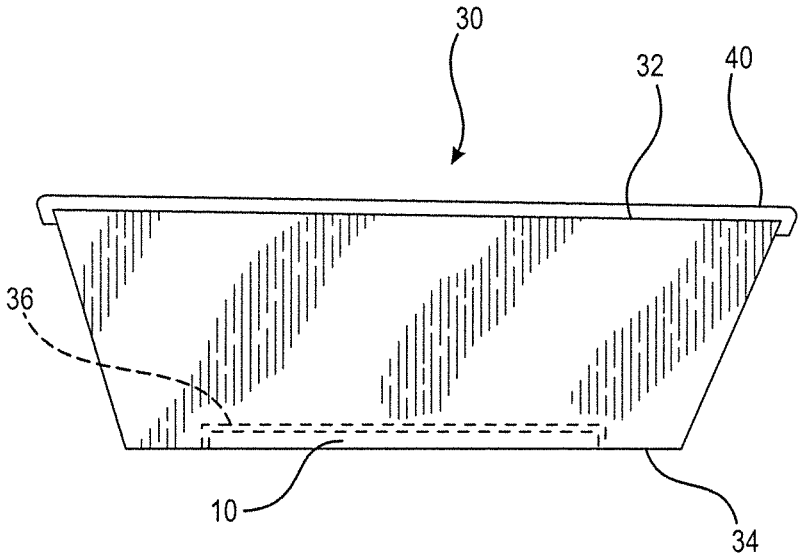
FIG. 4 is a side view of an embodiment of a mixing container including a recessed area for storing the tool of FIG. 1.
Figure 5:
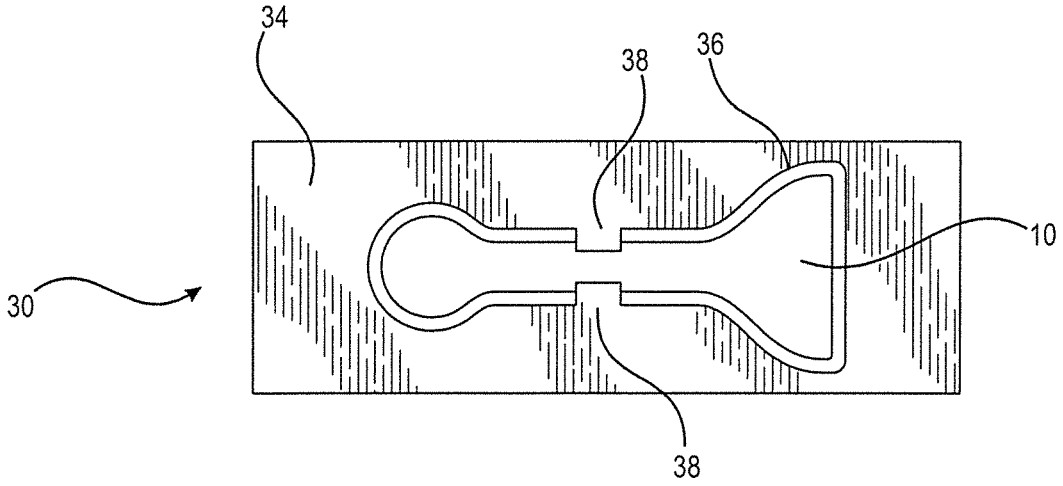
FIG. 5 is a bottom view of the mixing container of FIG. 4 including the tool of FIG. 1.

Referring now to FIGS. 4 and 5, an embodiment is illustrated that includes a container 30 having any suitable shape and size, where the container has an open top end 32 and a bottom end or bottom wall 34. The bottom wall 34 includes a recessed area or receptacle 36 that has a shape that is generally the same as the shape of the tool 10 in FIGS. 1-3. It should be appreciated that the shape and size of the receptacle 36 may be any suitable size and shape. The receptacle 36 has a depth that is generally the same as the thickness of the tool 10 such that the tool is flush with the bottom wall 34 when the tool is inserted in the receptacle. At least one securing arm, and preferably a pair of securing arms 38, is integrally formed with the bottom wall 34 and extends at least partially into the receptacle 36. The securing arms 38 extend at least partially over a portion of the tool 10 located in the receptacle 36 to secure the tool in the receptacle when the tool is not being used. It should be appreciated that the bottom wall 34 may include one, two or more securing arms 38 for securely holding the tool 10 in the receptacle 36. Also, the receptacle 36 is optionally located on an upper surface of the bottom wall 34.

In use, the tool 10 is removed from the receptacle 36 on the bottom wall 34 of the container 30. Pre-mixed joint compound or joint compound powder and water is added to the container 30 and the mixing member 26 of the tool is used to mix the joint compound in the container as described above. In an embodiment, a lid 40 (FIG. 4) may be attached to the sidewall and cover the open end of the container 30 to seal the container for temporary storage of the mixed joint compound or transport to another location. The mixed joint compound is then applied and spread on a surface using the blade 22 of the tool 10. After the joint compound is sufficiently spread on the surface, the tool 10 is reinserted into the receptacle 36 and secured in place by the securing arms 38 for transporting the tool 10 and the container 30 to another job location or job site. Thus, the combination of the container 30 and the tool 10 allows for easy and quick transport of the container and tool and minimizes the burden on the user as only one item needs to be stored and/or carried on a job site instead of multiple tools and containers.

While particular embodiments of the present joint compound tool and methods of using the tool have been shown and described, it will be appreciated by those skilled in the art that changes and modifications may be made thereto without departing from the invention in its broader aspects and as set forth in the following claims.

What is claimed is:

1. A joint compound tool comprising:

a handle defining a longitudinal axis and having a first end and a second end, and parallel edges defining a first width;

a blade portion attached to said first end and having a second width; and a solid, holeless mixing member attached to said second end, said mixing member having a third width, opposing tapered edges extending from said handle and an outer peripheral surface extending between the tapered edges, a cup-shaped portion being between the tapered edges and adjacent to the outer peripheral surface, wherein the entire shape of said mixing member is symmetrical about said longitudinal axis, wherein said second width and said third width are greater than said first width of said handle, wherein said handle and said blade portion each have substantially the same thickness, and wherein the mixing member is used to mix joint compound and the blade portion is used to apply the joint compound to a surface.

2. The joint compound tool of claim 1, wherein said blade portion includes a blade.

3. The joint compound tool of claim 1, wherein said blade portion is made of a first material and said handle and said mixing member are made of a second material, wherein said first material is different from said second material.

4. The joint compound tool of claim 1, wherein said blade portion and said mixing member are integrally formed with said handle.

5. The joint compound tool of claim 1, wherein at least a portion of said outer peripheral surface of said mixing member is curved.

* * * * *